US010209668B2

(12) United States Patent
Matsukawa et al.

(10) Patent No.: US 10,209,668 B2
(45) Date of Patent: Feb. 19, 2019

(54) IMAGE FORMING APPARATUS, PROCESS CARTRIDGE, DEVELOPING CARTRIDGE, AND DRUM CARTRIDGE

(71) Applicant: CANON KABUSHIKI KAISHA, Tokyo (JP)

(72) Inventors: Akihisa Matsukawa, Fuchu (JP); Toshiki Okamura, Yokohama (JP); Kuniaki Tamagaki, Kawasaki (JP); Takanori Watanabe, Kawasaki (JP); Hiroyoshi Iwayama, Yokohama (JP); Makoto Tokudome, Yokohama (JP); Hideo Kihara, Yokohama (JP); Naoki Hayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/942,652

(22) Filed: Apr. 2, 2018

(65) Prior Publication Data

US 2018/0224799 A1 Aug. 9, 2018

Related U.S. Application Data

(62) Division of application No. 15/650,229, filed on Jul. 14, 2017, now Pat. No. 9,971,298.

(30) Foreign Application Priority Data

Jul. 22, 2016 (JP) ..... 2016-144613

(51) Int. Cl.
*G03G 15/02* (2006.01)
*G03G 21/18* (2006.01)
(Continued)

(52) U.S. Cl.
CPC ..... *G03G 21/1814* (2013.01); *G03G 15/0258* (2013.01); *G03G 21/169* (2013.01);
(Continued)

(58) Field of Classification Search
USPC .... 399/91, 98–100, 107, 110, 111, 115, 130, 399/148–150
See application file for complete search history.

(56) References Cited

U.S. PATENT DOCUMENTS 5,937,244 A * 8/1999 Yoda ..... G03G 15/751 399/159
5,987,277 A 11/1999 Okabe
(Continued)

FOREIGN PATENT DOCUMENTS

JP 2002-108069 A 4/2002
JP 4510493 B2 7/2010

*Primary Examiner* — Hoan Tran
(74) *Attorney, Agent, or Firm* — Venable LLP

(57) ABSTRACT

An image forming apparatus in which a developer bearing member is disposed below a cleaning member, which cleans a charging member, so as to overlap with the cleaning member when viewed in a vertical direction and includes a base body and an elastic layer covering the base body and having a width in a longitudinal direction of the developer bearing member that accommodates the entire region of the cleaning member in the longitudinal direction. In the longitudinal direction, the cleaning member is disposed at a position where the entire region thereof in the longitudinal direction is accommodated in the width of the elastic layer.

19 Claims, 10 Drawing Sheets

(51) Int. Cl.
*G03G 21/16* (2006.01)
*G03G 21/00* (2006.01)

(52) U.S. Cl.
CPC ..... *G03G 21/1676* (2013.01); *G03G 21/1853* (2013.01); *G03G 21/0011* (2013.01)

(56) References Cited

U.S. PATENT DOCUMENTS

| | | | | |
|---|---|---|---|---|
| 6,215,967 | B1 | 4/2001 | Takeda et al. | |
| 6,219,504 | B1 * | 4/2001 | Matsuzaki ..... | G03G 21/1814 399/111 |
| 6,615,008 | B2 * | 9/2003 | Higeta ..... | G03G 21/181 399/109 |
| 7,251,441 | B2 | 7/2007 | Hagiwara et al. | |
| 9,086,670 | B2 | 7/2015 | Matsuda et al. | |
| 9,317,008 | B2 | 4/2016 | Handa et al. | |

* cited by examiner

IMAGE FORMING APPARATUS, PROCESS CARTRIDGE, DEVELOPING CARTRIDGE, AND DRUM CARTRIDGE

This is a divisional of U.S. patent application Ser. No. 15/650,229, filed Jul. 14, 2017.

BACKGROUND OF THE INVENTION

Field of the Invention

The present invention relates to an image forming apparatus using an electrophotographic system.

Description of the Related Art

An image forming apparatus, such as a copying machine, a printer, and a facsimile machine, using an electrophotographic system or an electrostatic recording system is provided with a charging means for charging a photosensitive member on which an electrostatic latent image and a developer image are to be formed. In recent years, a contact DC charging system in which a conductive charging member, instead of a corona charger, is brought into direct contact with a photosensitive member to charge uniformly the surface of the photosensitive member and suppress the generation of ozone has been widely used as the charging means. As an example of this system, a DC bias is applied to a charging roller which is a charging member, uniform discharge is performed while bringing the charging roller into rotational contact with the surface of the photosensitive member, and the surface of the photosensitive member is uniformly charged.

Meanwhile, in the contact DC charging system, the charging roller is in direct contact with the photosensitive member surface. Therefore, a toner and an external additive and the like contained in the toner are likely to adhere to the surface of the charging roller when the surface of the photosensitive member cannot be completely cleaned with a cleaning member. As a result, charging is likely to be poor. Accordingly, various means for cleaning the charging member in order to prevent contamination of the surface of the contact charging member in the abovementioned configuration have been suggested. Japanese Patent Application Publication No. 2002-108069 discloses a configuration for cleaning a contact charging member with a brush.

A cleaning device including a cleaning member such as a cleaning blade has been widely used as a means for removing and collecting residual toner from an image bearing member after a transfer step. The toner collected by the cleaning device becomes waste toner, but from the viewpoints of, for instance, environmental conservation and effective use of resources, it is desirable not to generate waste toner. Further, from the viewpoint of, for instance, miniaturizing the apparatus, it is preferable that a cleaning device be not provided. Accordingly, there is a cleanerless system (Japanese Patent No. 4510493) in which the toner remaining on the image bearing member is removed from the image bearing member by "cleaning simultaneous with development", collected and recycled.

When the contact DC charging system using the charging roller or the like is used in the cleanerless system, the contamination of the surface of the charging roller is significant. In the cleanerless system, the toner remaining on the photosensitive member (fogging, transfer residual, external additive, etc.) gets directly to the surface of the charging roller because there is no member for cleaning the photosensitive member. As a result, the toner or the like is likely to adhere to the surface of the charging roller. Therefore, image defects such as poor charging are likely to occur. In view of this problem, the configuration disclosed in Japanese Patent Application Publication No. 2002-108069 in which the contact charging member is cleaned with a brush appears to be effective.

However, where the amount of the toner remaining on the photosensitive member increases and the amount of the toner adhered to the charging member increases, the toner may stay on the cleaning member such as a brush and cause toner scattering. When a developing cartridge is present under the cleaning member, the scattered toner often adheres to the developing cartridge and causes troubles.

SUMMARY OF THE INVENTION

It is an object of the present invention to provide a technique capable of reducing various adverse effects caused by scattering of a developer from a cleaning member for cleaning a charging member.

In order to achieve the object described above, an image forming apparatus comprising:

an image bearing member;

a charging member that charges the image bearing member;

a cleaning member that contacts the charging member and cleans the charging member;

a developer bearing member that bears a developer for developing a latent image formed on the image bearing member; and a frame that accommodates the developer, wherein the developer bearing member is disposed below the cleaning member so as to overlap with the cleaning member when viewed in a vertical direction and includes a base body and an elastic layer that covers the base body and has a width that accommodates, in a longitudinal direction of the developer bearing member, the entire region of the cleaning member in the longitudinal direction; and in the longitudinal direction, the cleaning member is disposed at a position where the entire region thereof in the longitudinal direction is accommodated in the width of the elastic layer.

In order to achieve the object above, an image forming apparatus comprising:

an image bearing member;

a charging member that charges the image bearing member;

a cleaning member that contacts the charging member and cleans the charging member;

a developer bearing member that bears a developer for developing a latent image formed on the image bearing member and is disposed below the cleaning member so as to overlap with the cleaning member when viewed in a vertical direction;

a frame that accommodates the developer; and a shielding member which is a sheet-shaped member having magnetic properties and which is disposed in an opposing space between the cleaning member and the developer bearing member so as to have a region overlapping with the cleaning member and the developer bearing member when viewed in the vertical direction.

Further features of the present invention will become apparent from the following description of exemplary embodiments (with reference to the attached drawings).

DESCRIPTION OF THE EMBODIMENTS

Hereinafter, a description will be given, with reference to the drawings, of embodiments of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

Figure 2:
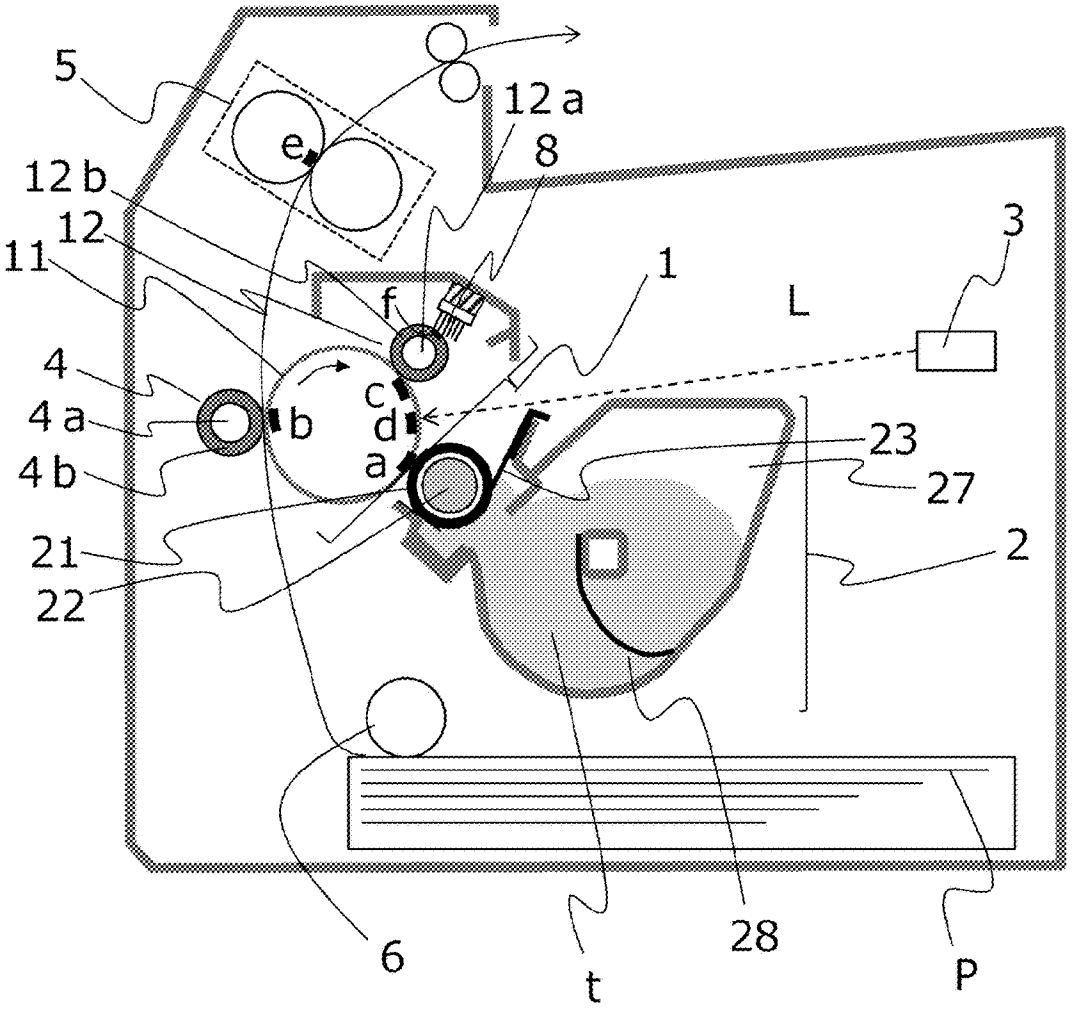
FIG. 2 is a schematic cross-sectional view of an image forming apparatus according to an example of the present invention.

FIG. 2 is a schematic configuration diagram of an image forming apparatus according to an example of the present invention. In this example, the application of the present invention to a monochrome laser printer using a transfer-type electrophotographic process will be described as an image forming apparatus according to this example. The process cartridge in the present example is configured of a charging device 1 (also referred to as a drum cartridge) and a developing device 2 (also referred to as a developing cartridge) which can be independently detachably attached to the main body of the image forming apparatus. The scope of the present invention is not limited to a two-cartridge configuration in which the charging device 1 and the developing device 2 can be independently detachably attached, and a one-cartridge configuration in which the charging device 1 and the developing device 2 are integrated can be also used, provided that the image forming apparatus can demonstrate the same effect.

<Charging>

In the present example, the photosensitive drum as the image bearing member is a negative-polarity OPC photosensitive member having a diameter (ϕ) of 24 mm. In the present example, a contact DC charging system is used, and a charging roller 12 serving as a charging member is brought into contact with the photosensitive drum 11 with a predetermined pressure to form a charging nip c. The applied DC voltage is set to such a value that the potential difference between the surface of the photosensitive drum 11 and the charging roller 12 is equal to or higher than the discharge starting voltage, specifically, a DC voltage of −1200 V is applied as a charging bias. At this time, the surface of the photosensitive drum 11 is uniformly charged by contact charging to a charging potential (dark potential) Vd=−650 V.

<Exposure>

A laser beam scanner 3 including a laser diode, a polygon mirror, and the like is provided in the main body as an exposure unit serving as a means for forming an electrostatic latent image on the charged image bearing member. The laser beam scanner 3 outputs an intensity-modulated laser beam correspondingly to a time-series electric digital pixel signal of target image information, and the uniformly charged surface of the rotating photosensitive drum 11 is scanned and exposed by the laser beam L. The laser power is adjusted so that the potential Vl becomes −100 V when the uniformly charged surface of the photosensitive drum 11 is entirely exposed with the laser beam.

<Development>

The developing device 2 as the developing means having the developing member supplies a developer to the electrostatic latent image formed on the photosensitive drum. In this example, a negative-charging magnetic toner is used as the magnetic developer. The development can be performed with a developing sleeve as the developing member, to which a developing bias (Vdc) −300 V is applied from a developing bias power source (not shown in the figure) serving as a voltage applying means for applying a voltage to the developing member.

<Transfer>

A transfer roller 4 of medium resistance which serves as a contact transfer means is used as a transfer means for transferring the developer image visualized by the developing means to the transfer medium. The transfer roller is brought into pressure contact with the photosensitive drum 11 in a predetermined manner to form a transfer nip b. In the transfer roller 4 used in this example a medium resistance foamed layer 4*b* is formed on a core metal 4*a*. The transfer roller has a roller resistance value of $5\times10^{8}\Omega$, and transfer is performed by applying a voltage of +2.0 kV to the core metal 4*a*.

<Fixing>

A fixing device 5 of a thermal fixing type is used as a fixing means. A recording material P which has passed through the transfer portion and to which the toner image has been transferred is separated from the surface of the rotating photosensitive drum 11 and introduced into this fixing device 5. The recording material is then heated and pressurized at a fixing nip e and discharged outside the apparatus as an image formed product (print copy).

<Cleanerless System>

Next, the cleanerless system of this example will be described in detail. In the present example, the untransferred developer remaining on the image bearing member after the transfer by the transfer means is collected by the developing means simultaneously with the development. Thus, the developer remaining on the image bearing member after the transfer of the developer image to the recording material is moved through the developer bearing member to a frame containing the developer and collected. In other words, the so-called cleanerless system is used in which a cleaning member for removing the untransferred toner which has not been transferred and remains on the photosensitive drum 11 from the photosensitive drum 11 is not provided.

The untransferred toner remaining on the photosensitive drum 11 after the transfer step is charged negatively in the same manner as the photosensitive drum 11 by an electric discharge in the space before the contact region (charging nip c) of the charging roller 12 and the photosensitive drum 11. The untransferred toner charged negatively passes by the charging roller 12 without adhering thereto due to the relationship of the potential difference (the surface potential of the photosensitive drum=−650 V, the charging roller potential=−1200 V) at the charging nip.

The untransferred toner that has passed through the charging nip c reaches a laser irradiation position. Since the amount of the untransferred toner is not so large as to shield the laser beam of the exposure means, the untransferred toner does not affect the step of forming the electrostatic latent image on the photosensitive drum. The toner that has passed through the laser irradiation position d and the toner on the non-exposed portion (the surface of the photosensitive drum not subjected to laser irradiation), in the contact region (developing nip a) between the developing sleeve 21 and the photosensitive drum 11, are collected by an electrostatic force to the developing sleeve 21 (developing potential −300 V). The toner on the exposed portion (the surface of the photosensitive drum subjected to laser irradiation) continues to be present on the photosensitive drum 11, as it is, without being collected by the electrostatic force. However, part of the toner may be collected by a physical force caused by the difference in peripheral speed between the developing sleeve 21 and the photosensitive drum 11. At this time, since the potential applied to the developing sleeve 21 is −300 V, the potential difference (Vback) with the photosensitive drum surface potential of −650 V is 350 V.

As described above, the toner which has not been transferred to the paper and remains on the photosensitive drum 11 is largely collected by the developing device 2. The toner collected by the developing device 2 is mixed with the toner remaining in the developing chamber 27 and reused.

<Developing Device>

Next, the configuration of the developing device 2 will be described in detail. The developing sleeve 21 serving as a developer bearing member is rotatably supported by the developing device 2 and is rotationally driven with respect to the photosensitive member at a peripheral speed of 140%. A magnet roller 22 serving as a magnetic force generating member is fixedly arranged on the inside (inner side) of a cylinder of the developing sleeve 21.

FIG. 3 shows details of the developing sleeve 21 and both end supports. The developing sleeve 21 has a hollow (sleeve-shaped, cylindrical) aluminum base tube (aluminum tube) 21*a* having an outer diameter of 11 mm and an inner diameter of 8.6 mm as a base body, and a conductive elastic rubber layer 21*c* having a thickness of 500 μm as an elastic layer that covers the aluminum base tube 21*a*. The surface of the conductive elastic rubber layer 21*c* is roughened to have a surface roughness Ra of 3.0 μm to 4.0 μm for conveying the developer. In the developing sleeve 21, the aluminum base tube 21*a* is exposed from the conductive elastic rubber layer 21*c* at both ends.

Figure 3A:
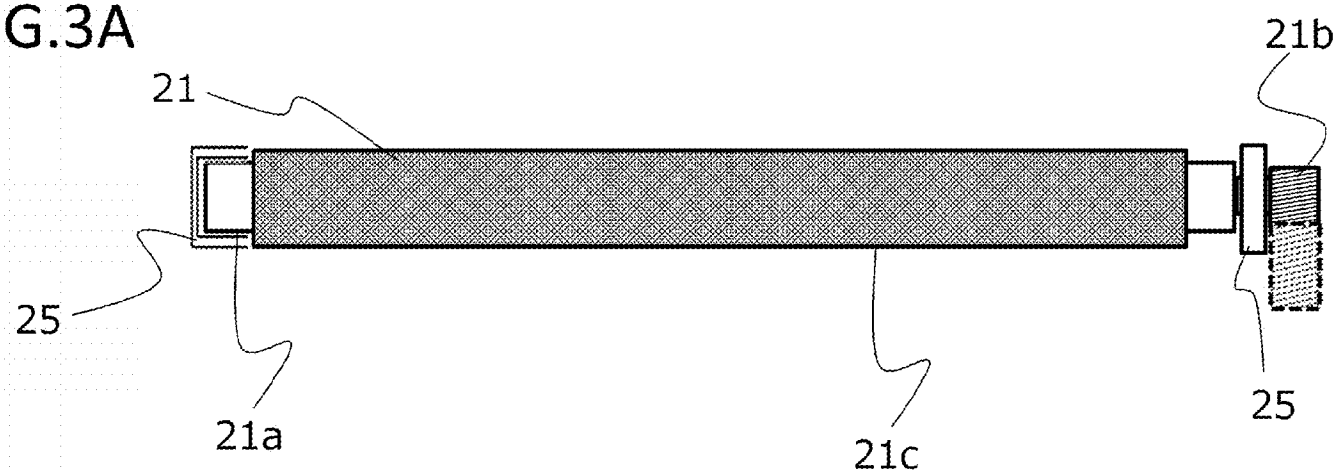
FIGS. 3A and 3B are layout views of an axial end portion of a developing sleeve in an example of the present invention.
Figure 3B:
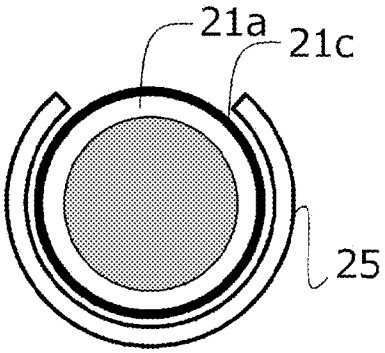

FIG. 3A shows the developing sleeve in the longitudinal direction of the cylinder thereof (referred to hereinbelow as the longitudinal direction). A sleeve gear 21*b* is mounted at the end of the aluminum base tube 21*a*, and the developing sleeve 21 is driven through the sleeve gear. FIG. 3B is a view showing the arrangement of the aluminum base tube and a bearing at the axial end of the developing sleeve at the non-driving side. The longitudinal ends are circumferentially received by bearings 25 and supported at both ends of the developing device 2.

The magnetic one-component black developer (negative charging characteristic) T serving as a magnetic developer in the developing device is stirred by a stirring member 28 inside the developing device and conveyed to the vicinity of the developing sleeve 21. The conveyed developer T is supplied to the surface of the developing sleeve by the magnetic force of a magnet roller. The developer supplied to the surface of the developing sleeve is uniformly thinned by passing by the developing blade 23 and triboelectrically charged to a negative polarity. The developer is then conveyed to the developing position where it contacts the photosensitive drum 11 to develop the electrostatic latent image.

Figure 4B:
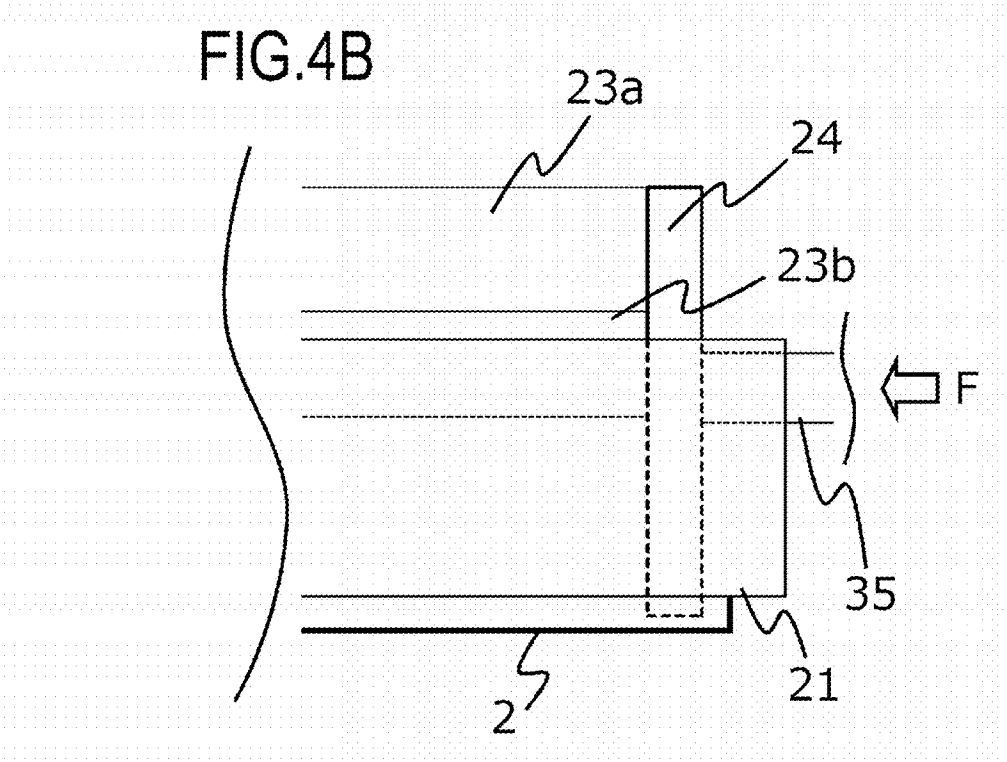
FIGS. 4A and 4B are explanatory views of a toner sealing member in an example of the present invention.
Figure 4A:
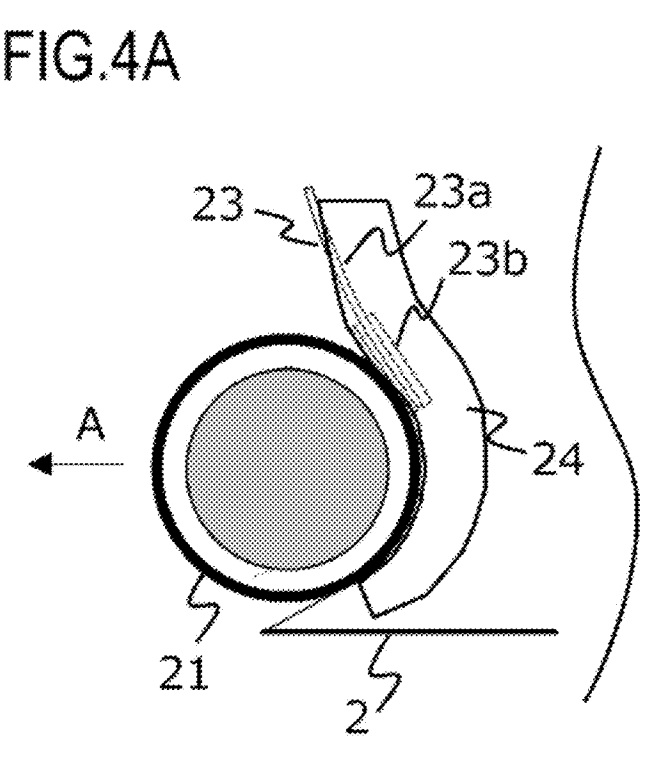

FIG. 4 is a layout view of the axial end portion of the developing sleeve of the developing device 2 of this example. FIG. 4A is a view showing the arrangement of the end portion from the outside in the axial direction of the developing sleeve, and FIG. 4B is a view showing the arrangement of the end portion from the direction of the contact region of the developing sleeve 21 and the photosensitive drum (direction A in FIG. 4A). In the present example, a toner sealing portion 24 is disposed on both longitudinal end portions of the developing sleeve 21 so as to be in contact with the surface of the developing sleeve 21 in order to prevent the toner from leaking from the inside of a developing chamber 27 of the developing device 2. Further, the toner sealing portion 24 is disposed on the side surface of the developing blade 23 and is brought into contact with the developing blade 23 by being pressed by a seal pressing member 35 on the side opposite to the developing blade side.

The toner sealing portion 24 is made of felt, has a width of 4 mm, a thickness of 5 mm, and an Asker C hardness of 45°, and is attached to the developing device 2 with a double sided tape. Measurement of Asker C hardness is carried out under the condition of a load of 100 g by bringing a pushing needle of an Asker C type hardness meter (manufactured by Kobunshi Keiki Co., Ltd.) against the surface of the toner sealing portion 24. When the developing sleeve 21 is set at a predetermined position and a seal pressing member 35 is inserted from the side opposite to the developing blade 23, as shown in FIG. 4B, the toner sealing portion 24 receives the pressing force F of the seal pressing member 35 and is brought into contact with the end portion of the developing blade 23.

<Charging Device>

Next, the configuration of the charging device 1 will be described in detail. The photosensitive drum 11 serving as an image bearing member is rotationally driven in the clockwise direction indicated by an arrow at a constant peripheral speed of 100 mm/sec (=process speed PS, printing speed). The charging roller 12 is configured of a core metal part 12*a* having a diameter (ϕ) of 6 mm and a rubber layer having a thickness of 2 mm. In this example, a charging roller gear is provided on the core metal 2*a* of the charging roller 12, and the charging roller gear is engaged with the drum gear provided at the end portion of the photosensitive drum 11. Therefore, as the photosensitive drum 11 is rotationally driven, the charging roller 12 is also rotationally driven. The peripheral speed of the surface of the charging roller 12 is set to be 115% or 120% of the peripheral speed of the surface of the photosensitive drum 11. There is a charging power source as a voltage applying means for applying a charging bias to the charging roller 12, and in this example, a DC voltage is applied from the charging power source to the core metal 2*a*. Since a cleanerless system is used in this example, contamination of the charging roller 12 by the toner or an external additive contained in the toner causes a problem. Accordingly, in the present example, a configuration is used in which the charging roller contamination is suppressed by a brush member 8 as the cleaning member.

Figure 5:
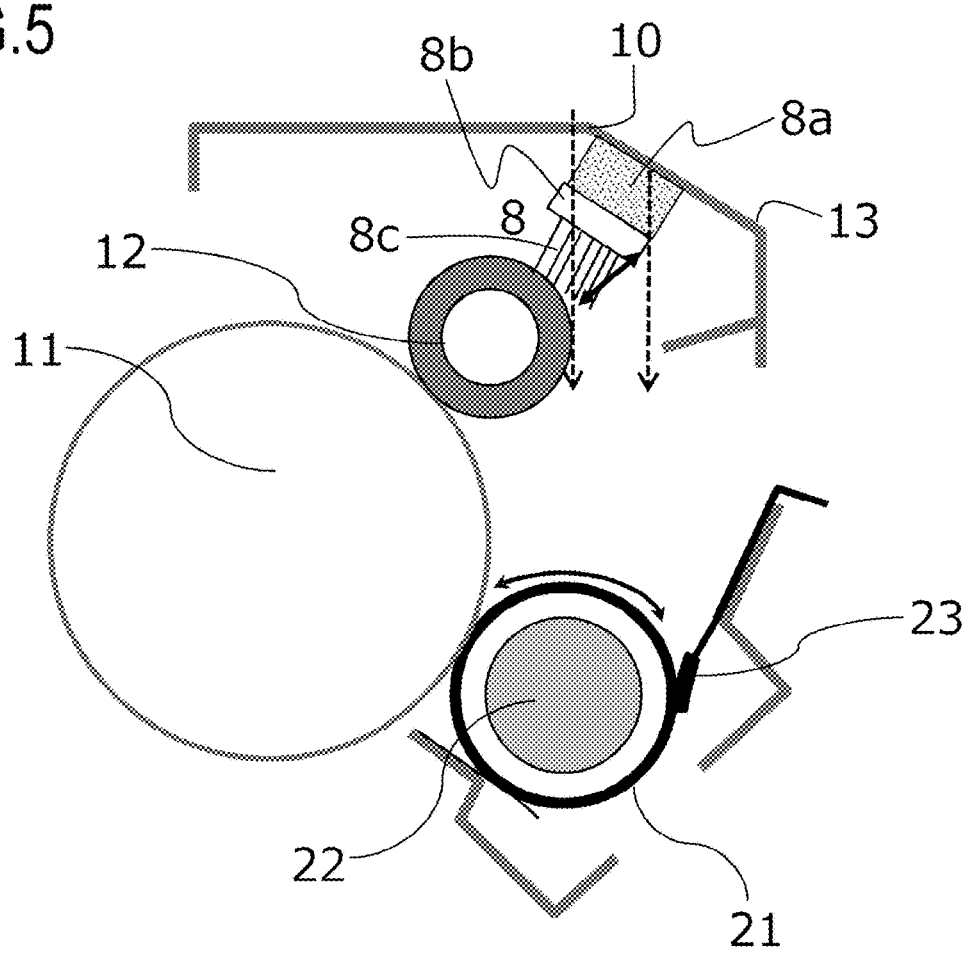
FIG. 5 is a schematic cross-sectional view of the process cartridge according to Example 1 of the present invention.

The relationship between the charging roller 12 and the brush member 8 and the effect thereof will be described hereinbelow in detail with reference to FIG. 5. The brush member 8 is disposed on a frame 13 so as to contact the surface of the charging roller 12. The brush member 8 is composed of an elastic layer 8*a*, a support 8*b*, and brush bristles 8*c*. The brush bristles 8*c* are electrically conductive, have a length of 2 mm and a thickness of 30 μm and are made of a resin such as nylon or rayon and sewn on the support 8*b* at a density of about 30,000 fibers/$cm^2$. By supporting the brush portion with the elastic layer 8*a*, it is possible to bring the brush portion into stable contact with the charging roller 12 and to suppress the deformation of the brush bristles 8*c* caused by the contact pressure with the charging roller 12. It is preferable that the brush bristles 8*c* have the same potential as that of the charging roller 12. Therefore, it is preferable that the resistance of the support 8*b* and the brush bristle 8*c* be about $10^2$ Ω·m to $10^8$ Ω·m.

With the above configuration, the toner attached to the surface of the charging roller 12 is negatively polarized by rubbing against the brush bristles 8*c* of the brush member 8. As a result, the toner is separated from the charging roller by the charging bias (−1200 V) and collected by the developing device 2 through the photosensitive drum 11 simultaneously with the development.

The features of this example will be described hereinbelow. In the present example, in order to suppress image defects which are due to toner scattering from the brush member, the longitudinal width of the brush member is set to be within the longitudinal width of the conductive elastic rubber layer of the developing sleeve in the image forming apparatus.

When the amount of the toner remaining on the photosensitive member increases due to an increase in the transfer residue caused by toner degradation in long-term use or an increase in fogging toner caused by a high-temperature and high-humidity environment, it becomes difficult to charge negatively the entire toner adhered to the charging roller at the time of contact with the brush member 8. As a result, part of the toner in contact with the brush member 8 may stay in the brush bristles 8*c* of the brush member 8. The toner staying in the brush bristles 8*c* spreads in the longitudinal direction of the brush member 8 and stays in the entire brush. As a result, when the bristles of the brush cannot retain the toner remaining thereon, the toner falls down and scatters. Where the developing configuration is below the brush member 8, as in the present example, the scattered toner sometimes adheres to the aluminum base tube 21*a* of the developing sleeve 21. Since the aluminum base tube 21*a* is peripherally supported by the bearings 25 provided at the developing frame, when the toner adheres to the aluminum base tube, the adhered toner is rubbed against the bearings and may be fixedly attached to the aluminum base tube. As a result, image defects occur due to an abnormal rise in rotational torque or uneven rotation of the developing sleeve.

Figure 1:
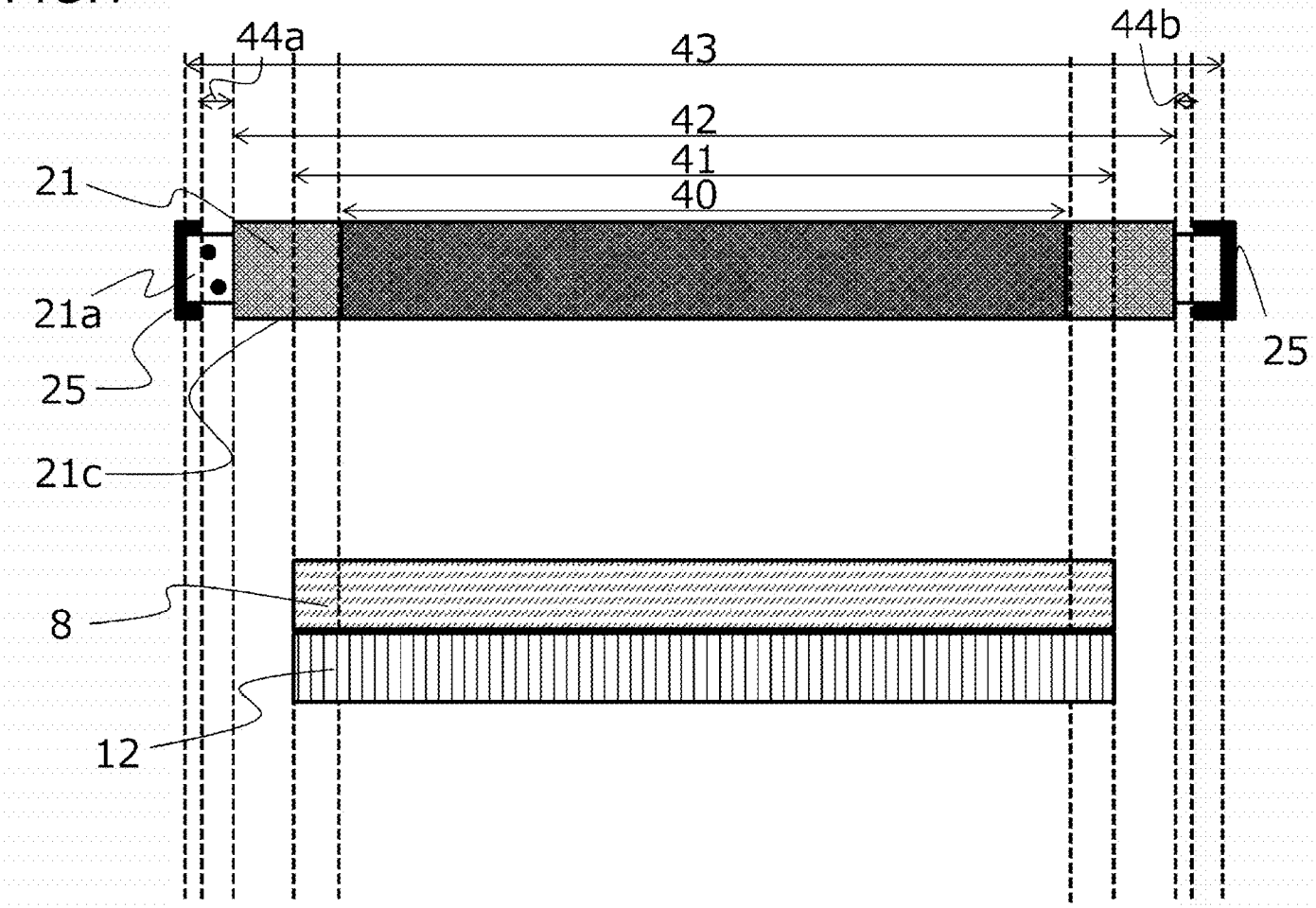
FIG. 1 is a schematic explanatory view of a process cartridge according to Example 1 of the present invention.

In order to solve the abovementioned problem, the entire longitudinal region of the brush member 8 is arranged to be accommodated in the entire longitudinal region of the conductive elastic rubber layer 21*c* of the developing sleeve 21. FIG. 1 shows details relating to the longitudinal width in the present example. The toner coat width 40 is 229 mm. The length 41 of the charging roller 12 and the brush member 8 is 230 mm. The width 42 of the conductive elastic rubber layer 21*c* of the sleeve 21 is 235 mm, and the width 43 of the aluminum base tube 21*a* is 243 mm. Further, the bearing 25 which receives the outer peripheral surface of the aluminum base tube 21*a* is set 4 mm apart from the end of the conductive elastic rubber layer 21*c* at the driving side 44*a* and 1 mm apart at a non-driving side 44*b*. As a result of the entire longitudinal region of the brush member 8 being arranged to be accommodated in the entire longitudinal region of the conductive elastic rubber layer 21*c* serving as the elastic layer of the developing sleeve 21, the toner scattered from the brush member 8 is unlikely to adhere to the aluminum base tube 21*a* of the sleeve 21. Therefore, it is possible to prevent the occurrence of a situation where the toner adhered to the aluminum base tube is caught between the bearing and the aluminum base tube, rubbed and fixedly attached. In the present example, the developer uses magnetic toner, but a non-magnetic toner may also be used.

Example 2

Figure 6:
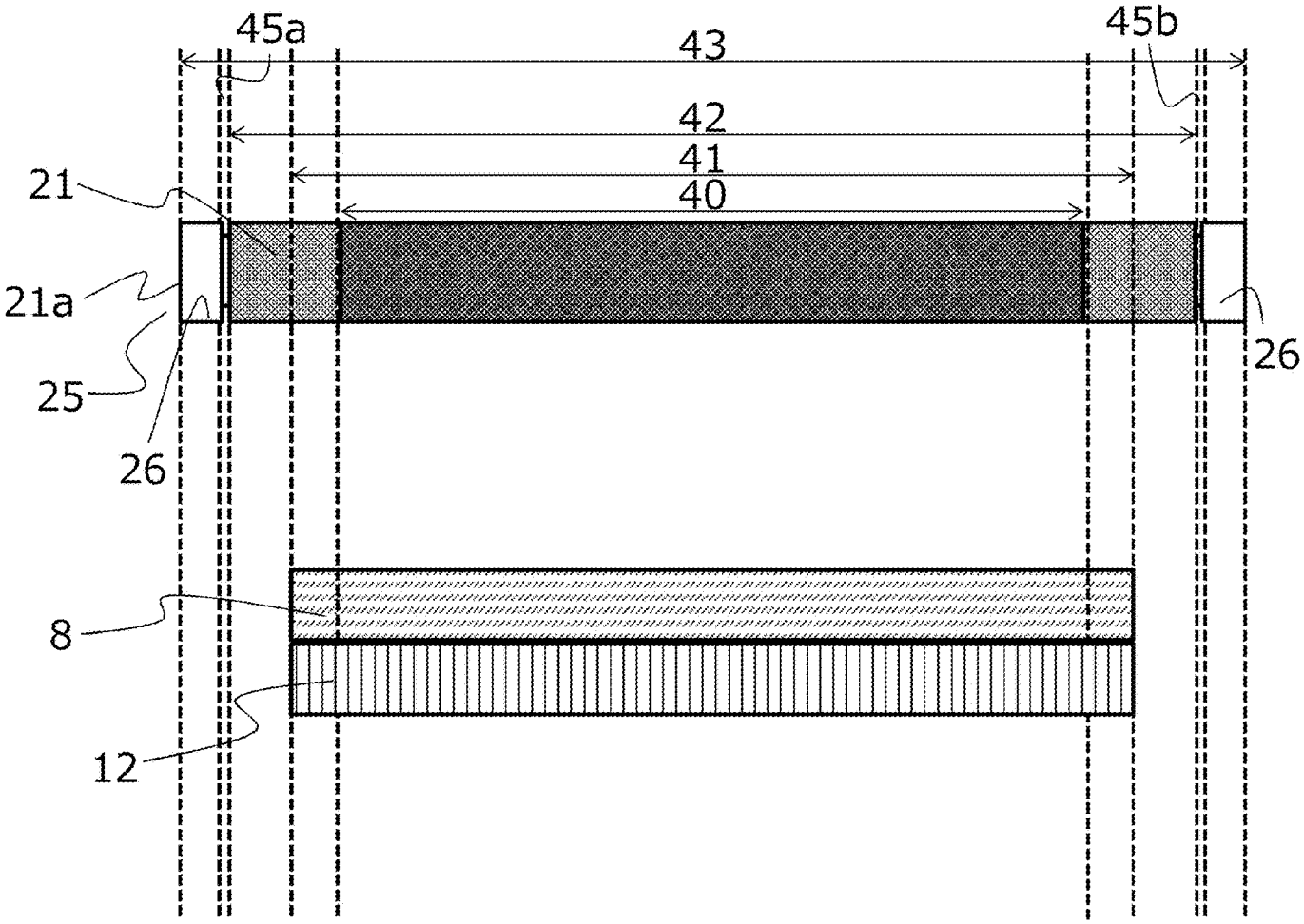
FIG. 6 is a schematic explanatory view of a process cartridge according to Example 2 of the present invention.

In Example 2, the image forming apparatus of Example 1 is used and a spacer member for keeping a predetermined distance between the sleeve 21 and the photosensitive drum 11 is provided at both ends of the developing sleeve (both sides of the conductive elastic rubber layer 21*c*). This spacer member is widely used in electrophotographic printers in order to keep the developing nip c constant. Where the toner adheres to the spacer member, the distance between the photosensitive drum and the developing sleeve does not become constant in the circumferential direction. Therefore, the developing nip c changes. As a result, an image defect called step unevenness in which the density varies with a developing sleeve period may occur. FIG. 6 shows details relating to the longitudinal width in Example 2. The spacer member 26 has a thickness of 450 μm and a width of 3 mm in the longitudinal direction, and distances 45*a* and 45*b* from the rubber ends to the spacer member 26 are 1 mm each. With the above arrangement, it is possible to suppress adhesion of the toner to the spacer member 26 according to the example.

Example 3

Example 3 of the present invention will be described hereinbelow using the above-described image forming apparatus shown in FIG. 2. The present example is characterized in that a toner scattering shielding member 14 is provided as shown in FIG. 7 in order to reduce the influence of toner scattering from the brush member on image formation.

In the cleanerless system, since there is no member for cleaning the photosensitive member, all the toner which has not been transferred to the paper and remains on the photosensitive drum 11 reaches the charging roller 12. Most of the toner is negatively charged by rubbing against the charging roller 12 and collected by the developing sleeve 21, without adhering to the charging roller 12, but part of the toner cannot be provided with negative polarity by rubbing against the charging roller 12 and adheres to the charging roller 12. The toner which has adhered to the charging roller 12 is thereafter charged negatively by rubbing against the brush member 8 in a nip f (FIG. 2) between the charging roller 12 and the brush member 8, adheres to the photosensitive drum 11, and is collected by the developing sleeve 21. Accordingly, the toner which has not been transferred to the paper and remains on the photosensitive drum 11 as described hereinabove is finally charged negatively because it can rub against the charging roller 12 and the brush member 8, and the charged toner is collected by the developing sleeve 21.

However, when the amount of the toner remaining on the photosensitive member increases due to an increase in the transfer residue caused by toner degradation due to approach to the limit of endurance (long-term use) or an increase in fogging toner caused by a high-temperature and high-humidity environment, it becomes difficult to charge negatively the entire toner adhered to the charging roller at the time of contact with the brush member 8. As a result, part of the toner may stay in the brush bristles 8*c* of the brush member 8. The toner staying in the brush bristles 8*c* spreads in the longitudinal direction of the brush member 8 and stays in the entire brush. As a result, when the bristles of the brush cannot retain the toner remaining thereon, the toner falls down and scatters. Where the developing configuration is below the brush member 8, as in the present example, the scattered toner sometimes adheres to the developing sleeve 21. In particular, when the toner adheres to the longitudinal position B (see FIG. 8) where the toner sealing member 24 is disposed in contact with the developing sleeve 21, the toner penetrates into the toner sealing member as the developing sleeve 21 rotates. As a result, the toner may stay on the felt surface of the toner sealing member 24 and be melted by heat caused by rubbing induced by the rotation of the developing sleeve 21. Melting of the toner can cause the following troubles. Thus, the fused toner (melted lumps of toner) can be formed on the surface of the toner sealing member 24 and the developing sleeve 21 can be damaged, or the function of preventing toner leakage which is demonstrated by the toner sealing member 24 can become unsatisfactory. There is no problem as long the amount of the toner is small, but a problem arises when a large amount of the toner penetrates into the toner sealing member.

Figure 7:
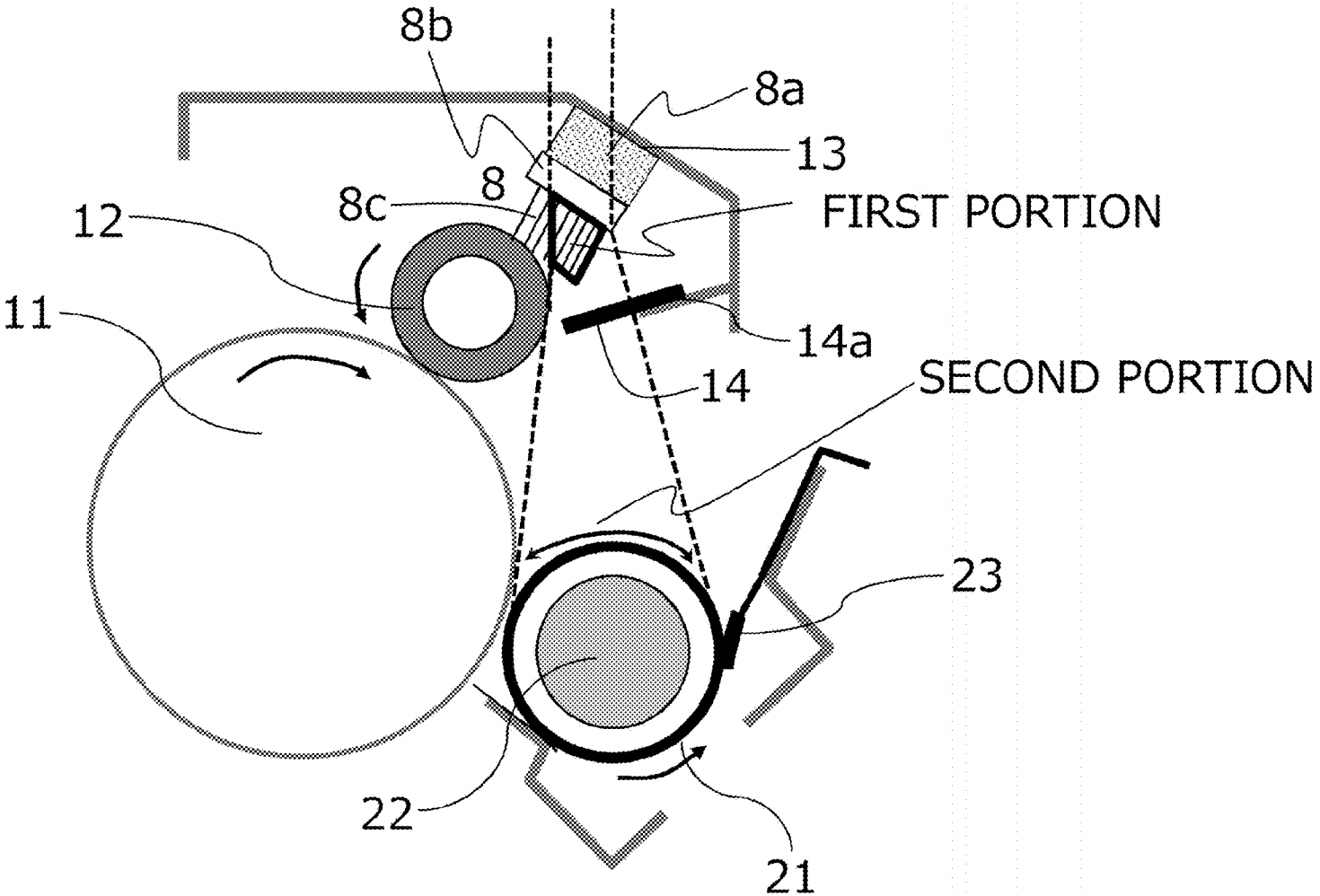
FIG. 7 is a schematic cross-sectional view of a process cartridge according to Example 3 of the present invention.
Figure 8:
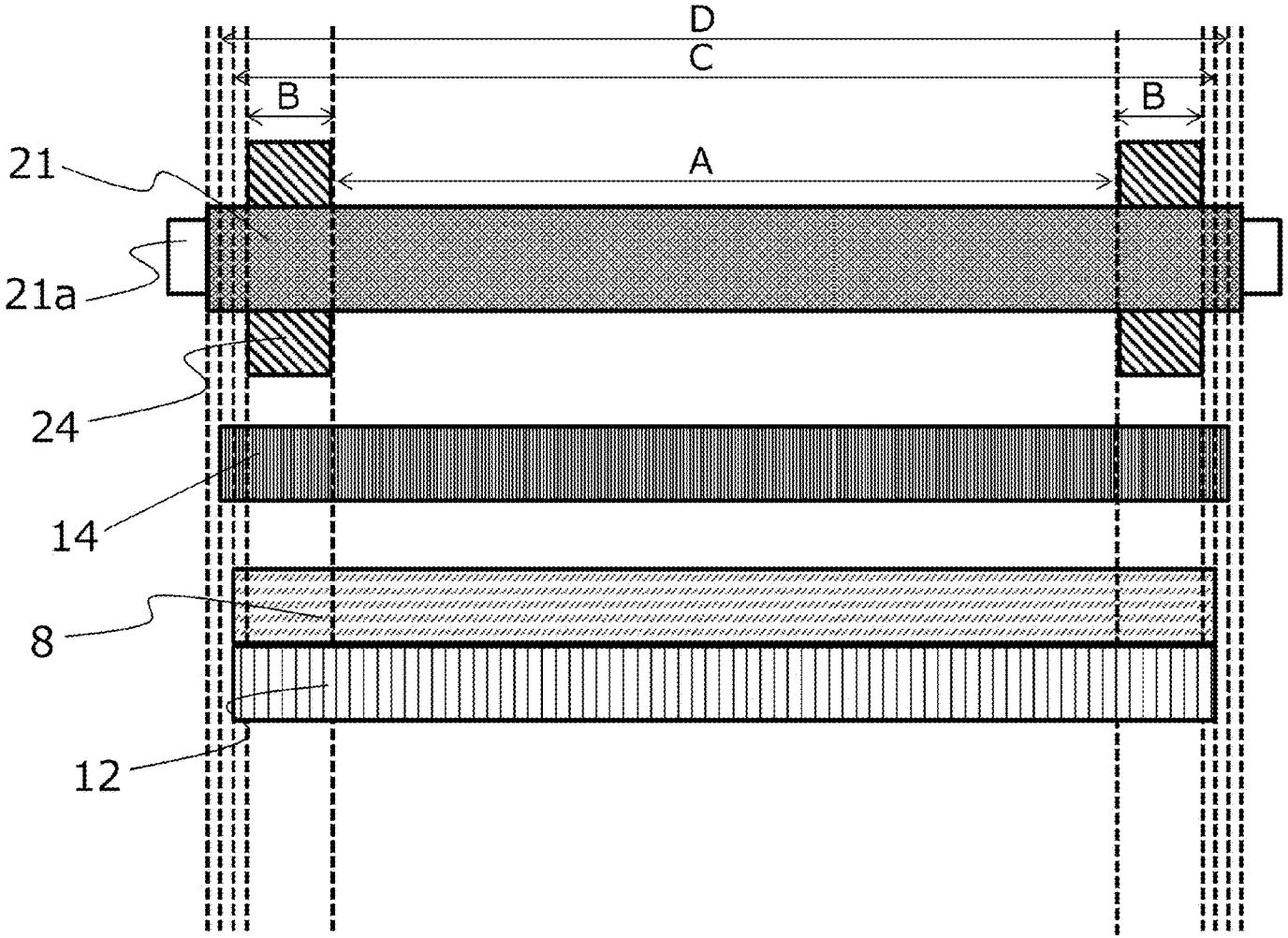
FIG. 8 is a schematic explanatory view of the process cartridge according to Example 3 of the present invention.

In order to solve the above problem, as shown in FIG. 7, a toner scattering shielding member 14 is arranged between the brush member 8 and the developing sleeve 21 (a region surrounded by the first portion and the second portion). The first portion, as referred to herein, is a thick frame portion which does not overlap with the charging roller 12 when viewed from the vertical direction as shown in FIG. 7. The second portion refers to the upper surface of the developing sleeve (the position visible when viewed from the brush bristles 8*c*). The region surrounded by the first portion and the second portion (an opposing space between the brush member 8 and the developing sleeve 21) is a path through which toner scattered from the brush member falls by gravity. Therefore, the presence of the toner scattering shielding member in the path makes it possible to reduce the adhesion of the toner to the developing device side. The toner scattering shielding member 14 uses a magnet sheet as a magnetic member and is attached to a support base 14*a* with a double-sided tape. Regarding the length, the arrangement is such that the toner sealing member is overlapped as shown in FIG. 8. The development opening width A is 218 mm. The length B of the toner sealing member on each end is 4 mm. The length D of the scattering shielding member 14 is 230 mm, and the length C of the charging roller 12 and the brush member 8 is 228 mm. Thus, as a result of disposing the toner scattering shielding member 14 so that it has a region overlapping the brush member 8 and the developing sleeve 21 when viewed in the vertical direction, the toner scattered from the brush member 8 is collected by the toner scattering shielding member 14 before the toner falls on the toner sealing member 24. Therefore, toner scattering to the toner sealing member is reduced. In the present example, the scattering prevention effect is enhanced by applying a magnetic force to the magnetic toner by using a magnet sheet having magnetism for the toner scattering shielding member 14, but such a configuration is not limiting. The toner scattering shielding member 14 is not limited to a magnetic material, and any member capable of shielding the toner can be used. Further, in this example, the magnetic toner is used as the developer, but a non-magnetic toner may be also used.

Example 4

In the configuration of Example 4, in addition to the shielding member of the image forming apparatus of Example 3, another shielding member is also provided on the developing device side, such that two shielding members are arranged.

Figure 9:
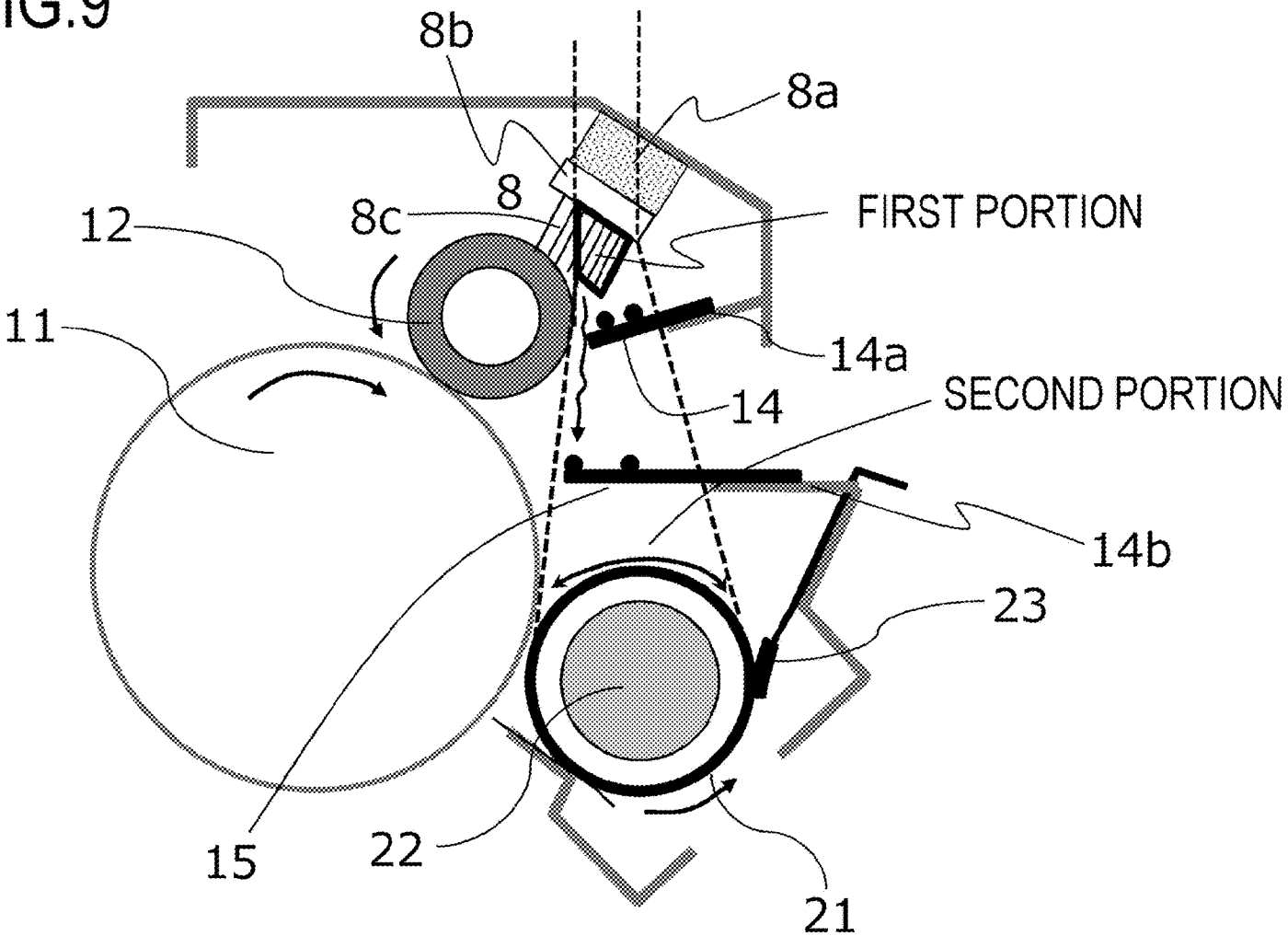
FIG. 9 is a schematic cross-sectional view of a process cartridge according Example 4 of the present invention.
Figure 10:
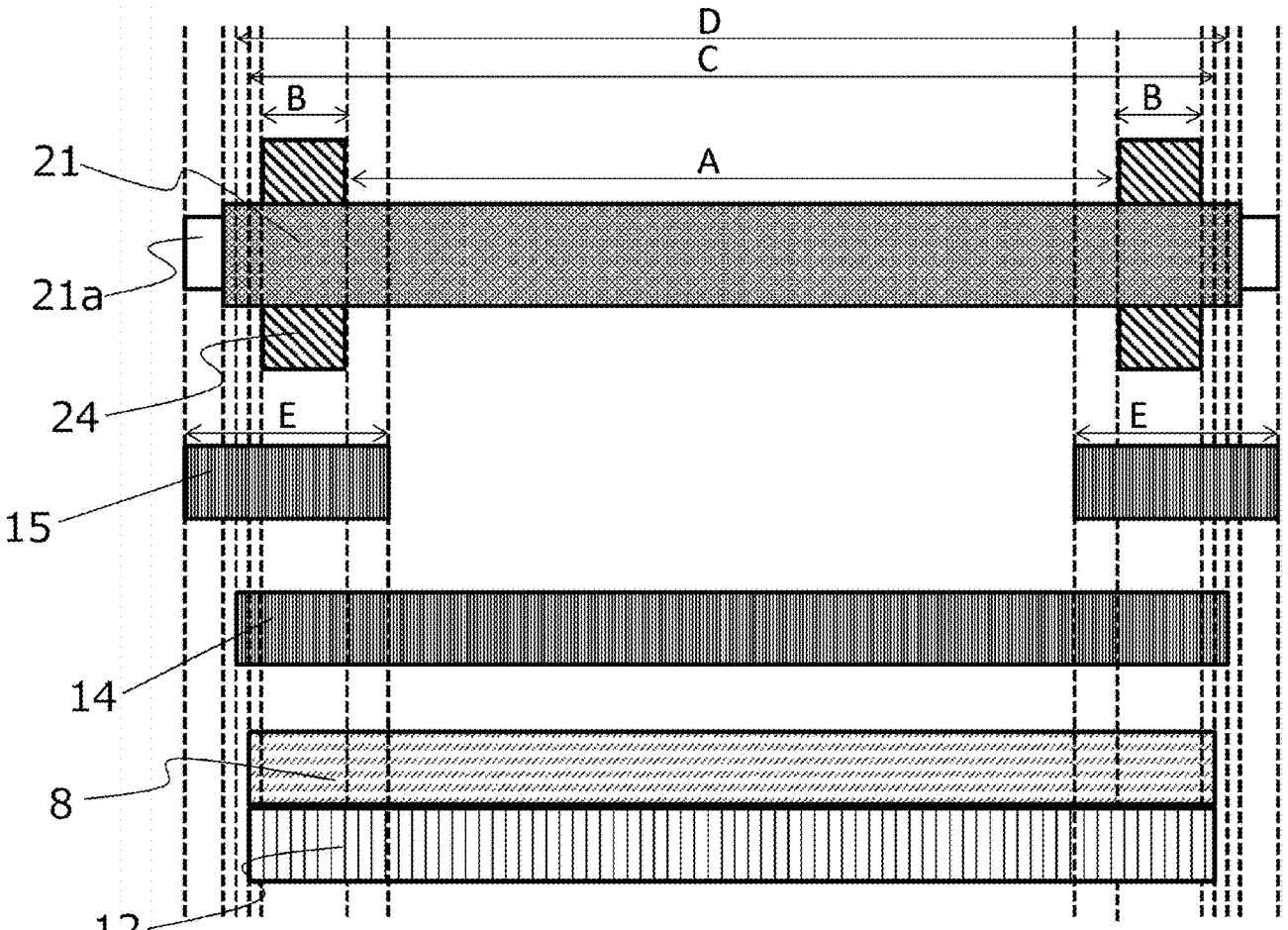
FIG. 10 is a schematic explanatory view of the process cartridge according to Example 4 of the present invention.

In Example 3, a toner scattering shielding member is provided on the charging device side, as shown in FIG. 7, to prevent the toner from being collected on the toner sealing member 24. In Example 4 a toner scattering shielding member 15 (the material is a magnet sheet as in Example 1) as a second shielding member is attached to a frame 14*b* on the developing apparatus side with a double-sided tape, as shown in FIG. 9, and arranged in a part of the region surrounded by the first portion and the second portion. Regarding the longitudinal direction, as shown in FIG. 10, the toner scattering shielding member 15 is arranged so as to overlap with the toner sealing member 24 when viewed from the vertical direction. More specifically, a pair (two) of the toner scattering shielding members 15 is provided at an interval in the longitudinal direction so as to overlap both end portions of the toner scattering shielding member 14 serving as the first shielding member, and the arrangement is such that the outer end portions of the toner scattering shielding members 15 in the longitudinal direction are positioned outside the end portion of the toner scattering shielding member 14 in the longitudinal direction. The length E of the toner scattering shielding member 15 is 30 mm. In this example, the material of the toner scattering shielding member 15 is not limited as long as the toner can be shielded. Further, the toner scattering shielding member may be formed of the frame on the developing device side, or the like, and imparted with a function of a shielding member. Contrary to the configuration of the present example, the toner scattering shielding member 15 serving as the second shielding member may be provided on the frame of the drum cartridge, and the toner scattering shielding member serving as the first shielding member may be provided on the frame of the developing cartridge. Further, the shielding members may be attached to the main body of the apparatus.

As a result of disposing two shielding members as described above, the opportunity to shield with the toner scattering shielding member 15 increases even when the toner scattered from the brush member 8 cannot be shielded by the toner scattering shielding member 14. Therefore, toner scattering to the toner sealing member 24 can be further reduced.

<Effects of the Examples>

As described above, according to the present examples, it is possible to reduce the influence on image formation produced by toner scattering from the brush member in the configuration in which the charging member is cleaned with a cleaning member such as a brush member.

Features of the abovementioned examples can be combined with each other as much as possible. For example, a configuration may be used in which the shielding member is disposed in the opposing space between the cleaning member and the developing sleeve, while arranging the members so that the entire region of the cleaning member in the longitudinal direction is accommodated in the longitudinal width of the elastic layer of the developing sleeve.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-144613, filed Jul. 22, 2016 which is hereby incorporated by reference herein in its entirety.

What is claimed is:

1. An image forming apparatus comprising:

an image bearing member;

a charging member that contacts the image bearing member and charges the image bearing member;

a cleaning member including a contact portion configured to contact the charging member and clean the charging member; and a developer bearing member including a base body and an elastic layer that covers the base body, configured to bear a developer for developing a latent image formed on the image bearing member, the developer bearing member being disposed below the cleaning member so as to overlap with the cleaning member when viewed in a vertical direction, wherein the image forming apparatus is configured so that remaining toner remaining on the image bearing member that is not used for forming an image is collected by the developer bearing member, a coat layer of the developer for developing the latent image is formed in a region of the elastic layer and the region is arranged inside of the both ends of the elastic layer in a direction of a rotation axis of the image bearing member, and an end of the contact portion of the cleaning member is disposed, in the direction of the rotation axis, between one end of the ends of the elastic layer and an end of the region in which the coat layer is formed, and the end of the region is on a same side of the one end of the elastic layer.

2. The image forming apparatus according to claim 1, wherein the cleaning member is a brush member.

3. The image forming apparatus according to claim 1, wherein the base body is an aluminum tube.

4. The image forming apparatus according to claim 1, wherein the base body is a cylindrical member and rotatably supported by a bearing, the developer bearing member comprises a magnetic force generating member disposed inside the base body, and the developer carried by the developer bearing member is a magnetic developer.

5. The image forming apparatus according to claim 1, wherein the developer bearing member comprises a spacer for maintaining a predetermined distance between the developer bearing member and the image bearing member on both sides of the elastic layer in the direction of the rotation axis.

6. The image forming apparatus according to claim 1, further comprising a shielding member disposed in an opposing space between the cleaning member and the developer bearing member so as to have a region overlapping with the cleaning member and the developer bearing member when viewed in the vertical direction.

7. A process cartridge detachably attachable to an apparatus main body of an image forming apparatus comprising:

an image bearing member;

a charging member that contacts the image bearing member and charges the image bearing member;

a cleaning member including a contact portion configured to contact the charging member and clean the charging member; and a developer bearing member including a base body and an elastic layer that covers the base body, configured to bear a developer for developing a latent image formed on the image bearing member, the developer bearing member being disposed below the cleaning member so as to overlap with the cleaning member when viewed in a vertical direction in a state that the process cartridge is attached to the apparatus main body, wherein the process cartridge detachably attachable to the apparatus main body of the image forming apparatus is configured so that remaining toner remaining on the image bearing member that is not used for forming an image is collected by the developer bearing member, a coat layer of the developer for developing the latent image is formed in a region of the elastic layer and the region is arranged inside of the both ends of the elastic layer in a direction of a rotation axis of the image bearing member, and an end of the contact portion of the cleaning member is disposed, in the direction of the rotation axis, between one end of the ends of the elastic layer and an end of the region in which the coat layer is formed, and the end of the region is on a same side of the one end of the elastic layer.

8. A developing cartridge detachably attachable to an apparatus main body of an image forming apparatus including an image bearing member, a charging member that contacts the image bearing member and charges the image bearing member, and a cleaning member including a contact portion configured to contact the charging member and clean the charging member, a developer image formed on the image bearing member being transferred to a recording material to form an image on the recording material, the developing cartridge comprising:

a developer bearing member including a base body and an elastic layer that covers the base body, configured to bear a developer for developing a latent image formed on the image bearing member, the developer bearing member being disposed below the cleaning member so as to overlap with the cleaning member when viewed in a vertical direction in a state that the developing cartridge is attached to the apparatus main body, wherein the developing cartridge detachably attachable to the apparatus main body of the image forming apparatus is configured so that remaining toner remaining on the image bearing member that is not used for forming an image is collected by the developer bearing member, a coat layer of the developer for developing the latent image is formed in a region of the elastic layer and the region is arranged inside of the both ends of the elastic layer in a direction of a rotation axis of the image bearing member, and an end of the contact portion of the cleaning member is disposed, in the direction of the rotation axis, between one end of the ends of the elastic layer and an end of the region in which the coat layer is formed, and the end of the region is on a same side of the one end of the elastic layer.

9. An image forming apparatus comprising:

an image bearing member;

a charging member that contacts the image bearing member and charges the image bearing member;

a cleaning member that contacts the charging member and cleans the charging member;

a developer bearing member that bears a developer for developing a latent image formed on the image bearing member and is disposed below the cleaning member so as to overlap with the cleaning member when viewed in a vertical direction; and a frame that accommodates the developer, wherein the image forming apparatus is configured so that remaining toner remaining on the image bearing member that is not used for forming an image is collected by the developer bearing member, and a shielding member that is a sheet-shaped member having magnetic properties is disposed in an opposing space between the cleaning member and the developer bearing member so as to have a region overlapping with the cleaning member and the developer bearing member when viewed in the vertical direction.

10. The image forming apparatus according to claim 9, further comprising:

a seal member that is disposed at both ends of the developer bearing member in a direction of a rotation axis of the image bearing member and seals between the developer bearing member and the frame, wherein the shielding member overlaps with the seal members when viewed in the vertical direction.

11. The image forming apparatus according to claim 9, wherein the developer bearing member is a sleeve-shaped member and has a magnetic force generating member disposed inside the developer bearing member, and the developer accommodated in the frame and carried by the developer bearing member is a magnetic developer.

12. The image forming apparatus according to claim 9, further comprising:

a second frame that supports the image bearing member, the charging member, and the cleaning member, wherein the shielding member is attached to the second frame.

13. The image forming apparatus according to claim 9, further comprising:

a second shielding member disposed at a height different from that of the shielding member in the opposing space, so as to have a region overlapping with the cleaning member and the developer bearing member when viewed in the vertical direction.

14. The image forming apparatus according to claim 13, wherein the second shielding member is attached to the frame.

15. The image forming apparatus according to claim 13, wherein an end portion of the second shielding member in a direction of a rotation axis of the image bearing member is located on an outer side of an end portion of the shielding member in the direction of the rotation axis.

16. The image forming apparatus according to claim 13, wherein two second shielding members are provided apart from each other in in a direction of a rotation axis of the image bearing member so as to overlap with both end portions of the shielding member in the direction of the rotation axis when viewed in the vertical direction.

17. A process cartridge, detachably attachable to an apparatus main body of an image forming apparatus, comprising:

an image bearing member;

a charging member that contacts the image bearing member and charges the image bearing member;

a cleaning member that contacts the charging member and cleans the charging member;

a developer bearing member that bears a developer for developing a latent image formed on the image bearing member and is disposed below the cleaning member so as to overlap with the cleaning member when viewed in a vertical direction in a state that the process cartridge is attached to the apparatus main body; and a frame that accommodates the developer, wherein the process cartridge detachably attachable to the apparatus main body of the image forming apparatus is configured so that remaining toner remaining on the image bearing member that is not used for forming an image is collected by the developer bearing member, and a shielding member that is a sheet-shaped member having magnetic properties is disposed in an opposing space between the cleaning member and the developer bearing member so as to have a region overlapping with the cleaning member and the developer bearing member when viewed in the vertical direction.

18. A drum cartridge detachably attachable to an apparatus main body of an image forming apparatus which includes a developer bearing member that bears a developer for developing a latent image formed on an image bearing member to form a developer image on the image bearing member, the drum cartridge comprising:

the image bearing member;

a charging member that contacts the image bearing member and charges the image bearing member; and a cleaning member that contacts the charging member and cleans the charging member, the developer bearing member being disposed below the cleaning member so as to overlap with the cleaning member when viewed in the vertical direction in a state that the drum cartridge is attached to the apparatus main body, wherein the drum cartridge detachably attachable to the apparatus main body of the image forming apparatus is configured so that remaining toner remaining on the image bearing member that is not used for forming an image is collected by the developer bearing member, and a shielding member that is a sheet-shaped member having magnetic properties is disposed in an opposing space between the cleaning member and the developer bearing member so as to have a region overlapping with the cleaning member and the developer bearing member when viewed in the vertical direction in a state that the drum cartridge is attached to the apparatus main body.

19. A developing cartridge detachably attachable to an apparatus main body of an image forming apparatus including an image bearing member, a charging member that contacts the image bearing member and charges the image bearing member, and a cleaning member that contacts the charging member and cleans the charging member, a developer image formed on the image bearing member being transferred to a recording material to form an image on the recording material, the developing cartridge comprising:

a developer bearing member that bears a developer for developing a latent image formed on the image bearing member and forming a developer image on the image bearing member and that is disposed below the cleaning member so as to overlap with the cleaning member when viewed in a vertical direction in a state that the developing cartridge is attached to the apparatus main body; and a frame that accommodates the developer, wherein the developing cartridge detachably attachable to the apparatus main body of the image forming apparatus is configured so that remaining toner remaining on the image bearing member that is not used for forming an image is collected by the developer bearing member, and a shielding member that is a sheet-shaped member having magnetic properties is disposed in an opposing space between the cleaning member and the developer bearing member so as to have a region overlapping with the cleaning member and the developer bearing member when viewed in the vertical direction.

* * * * *